US011739762B1

(12) United States Patent
Stummann

(10) Patent No.: US 11,739,762 B1
(45) Date of Patent: Aug. 29, 2023

(54) COMPOSITE IMPELLER WITH REPLACEABLE BLADES

(71) Applicant: Howden Turbo GmbH, Frankenthal (DE)

(72) Inventor: Simon Stummann, Ober-Ramstadt (DE)

(73) Assignee: HOWDEN TURBO GMBH, Frankenthal (DE)

( * ) Notice: Subject to any disclaimer, the term of this patent is extended or adjusted under 35 U.S.C. 154(b) by 0 days.

(21) Appl. No.: 17/956,408

(22) Filed: Sep. 29, 2022

(51) Int. Cl.
*F04D 29/22* (2006.01)
*F04D 29/62* (2006.01)
*F04D 29/28* (2006.01)

(52) U.S. Cl.
CPC ..... *F04D 29/22* (2013.01); *F04D 29/28* (2013.01); *F04D 29/62* (2013.01)

(58) Field of Classification Search
CPC ..... F04D 29/22; F04D 29/28; F04D 29/62
See application file for complete search history.

(56) References Cited

U.S. PATENT DOCUMENTS

| | | | | |
|---|---|---|---|---|
| 1,611,547 | A | 12/1926 | Miller | |
| 3,625,635 | A | 12/1971 | Stonack | |
| 5,944,486 | A | 8/1999 | Hodgkins, Jr. | |
| 6,854,960 | B2 | 2/2005 | Van Dine et al. | |
| 7,762,778 | B2 * | 7/2010 | Purvines | B23P 15/006 416/186 A |
| 8,439,642 | B2 * | 5/2013 | Scott | F04D 7/045 415/206 |
| 9,234,524 | B2 * | 1/2016 | Shoji | F04D 29/30 |
| 9,328,612 | B2 | 5/2016 | Kubel et al. | |
| 9,482,095 | B2 | 11/2016 | Drane | |
| 9,890,797 | B2 * | 2/2018 | Wilfley | F04D 29/628 |
| 9,945,389 | B2 | 4/2018 | Cahill et al. | |
| 10,415,587 | B2 | 9/2019 | Cahill et al. | |
| 10,563,665 | B2 | 2/2020 | Rice | |
| 10,914,314 | B2 | 2/2021 | Cahill et al. | |
| 2013/0164139 | A1 | 6/2013 | Liu et al. | |
| 2020/0248710 | A1 | 8/2020 | Rice | |

FOREIGN PATENT DOCUMENTS

| | | | |
|---|---|---|---|
| CN | 202768476 | U | 3/2013 |
| CN | 104929968 | B | 6/2017 |
| CN | 110056538 | A | 7/2019 |
| CN | 212454939 | U | 2/2021 |
| GB | 2288441 | A | 10/1995 |

* cited by examiner

*Primary Examiner* — Sabbir Hasan
(74) *Attorney, Agent, or Firm* — Edell, Shapiro & Finnan, LLC

(57) ABSTRACT

A composite impeller for a turbofan system is disclosed. The impeller includes a hub and a plurality of replaceable impeller blades coupled to the hub. Each replaceable impeller blade includes a root, a tip, a platform extending laterally from the root, and a shroud extending laterally from the tip to engage another tip of an adjacent impeller blade. The plurality of replaceable impeller blades and the hub define the enclosed centrifugal impeller.

6 Claims, 6 Drawing Sheets

COMPOSITE IMPELLER WITH REPLACEABLE BLADES

FIELD OF INVENTION

The present disclosure is directed toward turbomachinery and, in particular, a composite impeller with replaceable blades.

BACKGROUND

Generally, impellers for compressors, fans, and/or blowers are usually constructed by welding impeller paddles/blades (i.e., the radially extending elements) to a rear disk/back cover and/or a central hub. In some instances, a front cover is also fixedly connected to the paddles to sandwich the paddles between a front cover and a back cover. Most often, these impellers are built from steel and, thus, the paddles are welded to the rear disk, central hub, and/or front cover. Thus, the final impellers are typically extremely heavy and typically have a high moment of inertia. Moreover, these impellers are typically difficult to manufacture, at least because precise welding operations must be executed in very tight spaces along edges of paddles and, due to the weight, sometimes, these complex welds need to be performed on-site. Additionally, these welded steel constructions are very difficult and/or expensive to service and/or maintain because repair often requires weld repairs and/or deconstruction of the impeller (e.g., by cutting metal and/or weld joints). Moreover, the impeller may need to be transported to a separate factory to conduct repairs.

To try to combat some of these issues, some impellers have been built from fiber composite material. Typically, these fiber composite impellers have a substantially similar geometry as steel impellers and provide a relatively unitary/monolithic impeller. Changing the material can improve performance of the impeller and/or ease shipping and manufacturing burdens/costs, as compared to a steel impeller. For example, fiber composite material provides higher static and fatigue strengths, has a lower weight, and has a lower moment of inertia. Unfortunately, thus far, these fiber composite impellers have proven too complex and expensive to produce. Moreover, these unitary fiber composite impellers cannot be repaired.

SUMMARY

The present disclosure is directed towards a composite impeller assembly for turbomachinery, such as a centrifugal blower. In some aspects, a composite centrifugal impeller blade includes a root, a tip opposite the root, a platform extending laterally from the root in a first direction. and a shroud extending laterally from the tip in a second direction. At least one of the platform and the shroud are configured to engage a second impeller blade to form at least a portion of an impeller with a plurality of additional impeller blades and a cover plate.

In one aspect, the blade root may be configured to engage a hub. The impeller blade may cooperate with the hub, the second impeller blade, and the plurality of additional impeller blades to define an enclosed impeller. Each impeller blade of the plurality of additional blades, including the second impeller blade, may include an additional platform; and the platform of the impeller blade may cooperate with the additional platforms of the plurality of impeller blades to define a back plate that supports the impeller. Each impeller blade of the plurality of additional blades, including the second impeller blade, may further include an additional shroud. The shroud of each impeller blade may cooperate with the additional shrouds of the plurality of impeller blades to define the cover plate.

In some instances, the platform may engage a root of the second impeller blade.

In one implementation of the centrifugal impeller blade, the second direction may be parallel to the first direction, and the shroud is configured to engage a tip of the second impeller blade. Alternatively, the second direction may be opposite and parallel to the first direction, and the shroud may engage a tip of a third impeller blade.

In accordance with one or more embodiments, an enclosed centrifugal impeller includes a hub and a plurality of replaceable impeller blades coupled to the hub. Each replaceable impeller blade includes a root, a tip, a platform extending laterally from the root, and a shroud extending laterally from the tip to engage another tip of an adjacent impeller blade. The plurality of replaceable impeller blades and the hub define the enclosed centrifugal impeller.

In some aspects, the shrouds of the plurality of replaceable impeller blades may cooperate to define a cover plate.

In some implementations, at least one of the platform and the shroud may include an engagement mechanism for coupling the plurality of replaceable impeller blades.

In some instances, each platform of each replaceable impeller blade may be configured to engage another root of the adjacent impeller blade to define a back plate. Alternatively, each platform of each replaceable impeller blade may be configured to engage another root of another impeller blade to define a back plate.

In some aspects, each replaceable impeller blade is removably coupled to the hub.

In accordance with yet another embodiment, a method of repairing a centrifugal impeller includes removing a damaged impeller blade from a hub of the centrifugal impeller and fastening a new impeller blade to the hub. The impeller blade includes a platform and a shroud. The method further includes engaging a tip of an adjacent impeller blade with a shroud of the new impeller blade to complete a cover plate and completing a back plate with the platform.

In some instances, the method may include engaging a root of the adjacent impeller blade with the platform. Alternatively, the method may include engaging a root of a second adjacent impeller blade with the platform.

In some implementations, removing the damaged impeller blade from the hub may include disengaging the platform of the damaged impeller blade from the adjacent impeller blade. Alternatively, removing the damaged impeller blade from the hub may include disengaging the platform of the damaged impeller blade from a second adjacent impeller blade.

In some aspects, removing the damaged impeller blade from the hub may include disengaging the shroud of the damaged impeller blade from the adjacent impeller blade.

BRIEF DESCRIPTION OF THE DRAWINGS

To complete the description and in order to provide for a better understanding of the techniques presented in this application, a set of drawings is provided. The drawings form an integral part of the description and illustrate an embodiment of the present application, which should not be interpreted as restricting the scope of the present application, but just as an example of how the techniques presented herein can be carried out. The drawings comprise the following figures.

Like reference numerals have been used to identify like elements throughout this disclosure.

DETAILED DESCRIPTION

Figure 1:
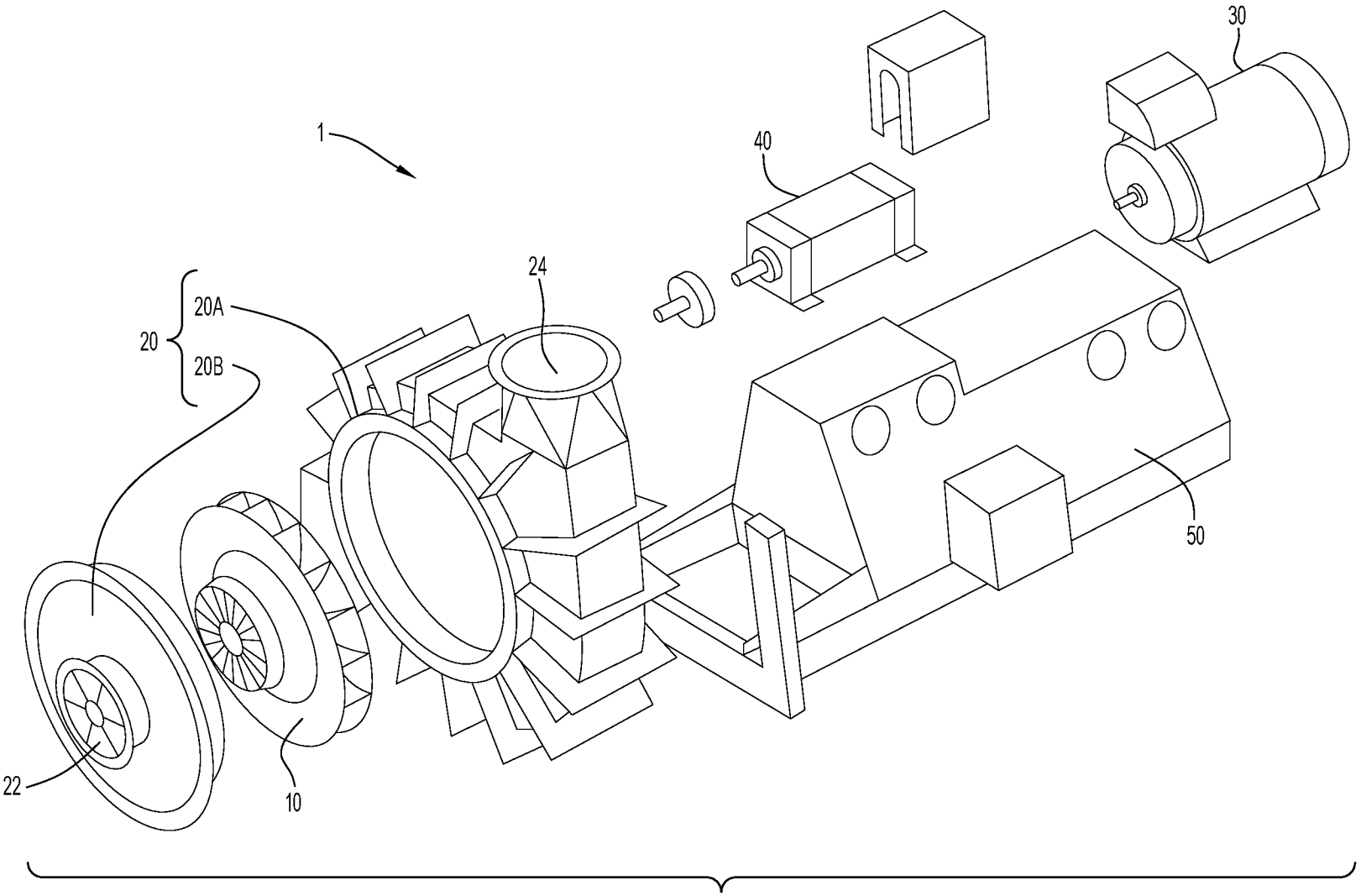
FIG. 1 is an exploded view of a turbofan system including an impeller formed in accordance with an exemplary embodiment of the present application.

The following description is not to be taken in a limiting sense but is given solely for the purpose of describing the broad principles of the invention, Embodiments of the present application will be described by way of example, with reference to the above-mentioned drawings showing elements and results according to the techniques presented herein.

Generally, the present application is directed to a composite impeller for a turbofan system with interchangeable composite paddles or blades. Each blade includes laterally extending portions (e.g., a platform and a shroud) that define a portion of a back plate (e.g., rear plate or support plate) or a portion of a cover plate (e.g., a front plate, a shroud, a wheel cone or a rim). The laterally extending portions are formed integrally with the blades and, thus, assembling a plurality of blades to a central hub defines the black plate and the cover plate. Put another way, an enclosed impeller is formed by mechanically securing an interior portion (root) of each blade to a central hub (e.g., a metal hub) and the laterally extending portions of each blade to one or more adjacent blades. In at least some instances, a fixing element may connect an interior portion of the blade to the hub. Alternatively, the interior portion may be directly connected to the hub. Either way, the blades removably connect to the hub via a blade surface that is generally parallel to the surface of the hub (i.e., the blade is supported by the hub).

Regardless of how the plurality of blades couple to the hub, the assembled composite impeller may be stronger than a conventional steel impeller. For example, the laterally extending portions of the composite blades (e.g., portions that define portions of back plate and portions of a cover plate) may provide an impeller with greater strength and less weight than a steel impeller having welded T-joints between a paddle and a back plate and between the paddle and a cover plate. That is, the composite impeller, as described herein, may be able to withstand a greater stress and/or strain than a heavier, metal impeller of similar size. Thus, the composite impeller may also have a lower moment of inertia and hence a reduced amount of power required to startup the impeller as compared to steel impellers., The lower density of the chosen composite material may reduce the centrifugal forces of the blades and hence the stresses inside the blades. Further, the replaceable composite blades may be easily removed and replaced without sending the impeller to a remote factory for repair. Thus, a user may repair the composite impeller at the location of the turbofan system. Another advantage over conventional impellers includes reduced complexity in manufacturing the blades and assembling the impeller (e.g., no internal welding or intricate composite molding techniques). Yet another advantage includes adjusting the impeller flow volume by reconfiguring the inlet and outlet areas of the impeller. For example, the size of the hub may be adjusted, and/or the downstream portions of the impeller may be extended with an outlet attachment.

Now referring to FIG. 1 for a description of an exemplary embodiment of a turbofan system 1, according to an embodiment. The turbofan system 1 includes an impeller 10 housed in a casing 20. The impeller 10 is coupled to a motor 30 via a bearing unit 40. A support structure 50 supports the impeller 10, the casing 20, the motor 30, and the bearing unit 40. The casing 20 includes a base portion 20A and a cap portion 20B. The cap portion 20B defines an inlet 22 to the impeller 10 and the base portion 20A defines a volute for receiving the impeller 10 and an outlet 24, The motor 30 and the bearing unit 40 are configured to rotate the impeller 10 to induce a flow of air or other gas composition from the inlet 22 through the impeller 10 and casing 20 to the outlet 24. The motor 30 may have a variable frequency drive that adjusts the rotational speed of the impeller based on a control signal or the motor may have a fixed speed, The bearing unit 40 supports the impeller and the shaft in axial and radial direction.

Figure 2:
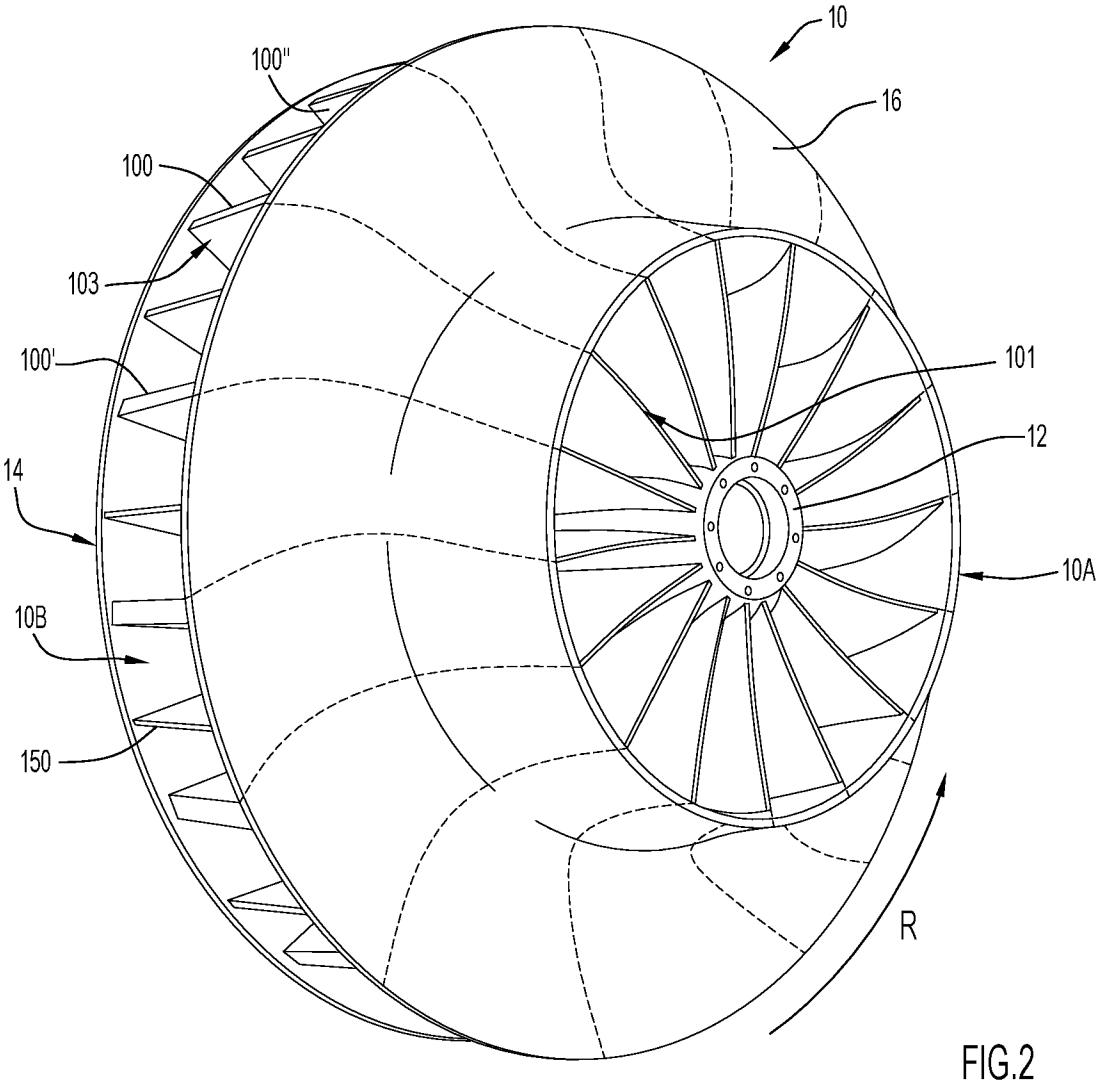
FIG. 2 is a perspective view of the impeller of the turbofan system of FIG. 1.

Now referring to FIG. 2, the composite impeller 10 according to an embodiment is illustrated. The impeller 10 is a centrifugal impeller having a hub 12, an axial inlet 10A, a radial outlet 10B, a hack plate 14, a cover plate 16, and composite blades or paddles 100 mechanically coupled or fastened together. For clarity. FIG. 2 includes broken lines that generally demarcate the locations of the blades 100. These broken lines do not form part of the impeller 10. Instead, the broken lines help depict how each blade 100 extends from an upstream end 101 at the axial inlet 10A to a downstream end 103 at the radial outlet 10B. Thus, the upstream ends 101 of the blades 100 define the axial inlet 10A and the downstream ends 103 of the blades 100 define the radial outlet 10B of the impeller 10. Additionally, each blade 100 engages a first adjacent blade 100' and/or a second engagement blade 100" so that, when engaged (e.g., mechanically coupled together), the blades 100 define the back plate 14 and the cover plate 16. That is, each blade 100 is disposed between a first adjacent blade 100' and a second adjacent blade 100", In the depicted embodiment, the impeller 10 also includes a plurality of bladelets 150 between the blades 100, however the bladelets 150 are not necessary. In fact, in sonic implementations, the bladelets 150 may be omitted.

The impeller 10 may be formed from a composite material. For example, each blade 100 may be formed from prepreg composite fabric, carbon fibers, resin, or any other suitable materials. Because the blades 100 define the back plate 14 and the cover plate 16, they are also formed from the same composite material as the blades 100. Additionally, the hub 12 may also be formed from metal or a composite material e.g., carbon fiber, glass fiber, and/or resin). The composite material allows the impeller 10 and blades 100 to be easily formed into any desired shape, including easily defining coupling elements. Accordingly, the blades 100 may be coupled to each via the coupling elements other without sacrificing structural integrity of the composite impeller. In fact, mechanically coupling the composite blades 100 together may improve the overall integrity of the composite impeller 10 as compared to steel impellers. Further, the composite material provides comparable strength to steel, but with much less weight. Thus, a moment of inertia of the composite impeller 10 may be much less than a steel impeller of comparable size.

During operation, the impeller 10 rotates in a direction of rotation R. The blades 100 induce a flow of air through the axial inlet 10A, through the impeller 10 and out the radial outlet 10B. The back plate 14 and the cover plate 16 help guide the flow of air through the impeller 10, while also structurally reinforcing the impeller 10. In the depicted embodiment, the direction of rotation R is illustrated in a counterclockwise direction about the hub 12. However, in some implementations, the blades 100 may be configured to rotate in a clockwise direction to induce a flow of air from the inlet 10A to the outlet 10B.

Figure 3:
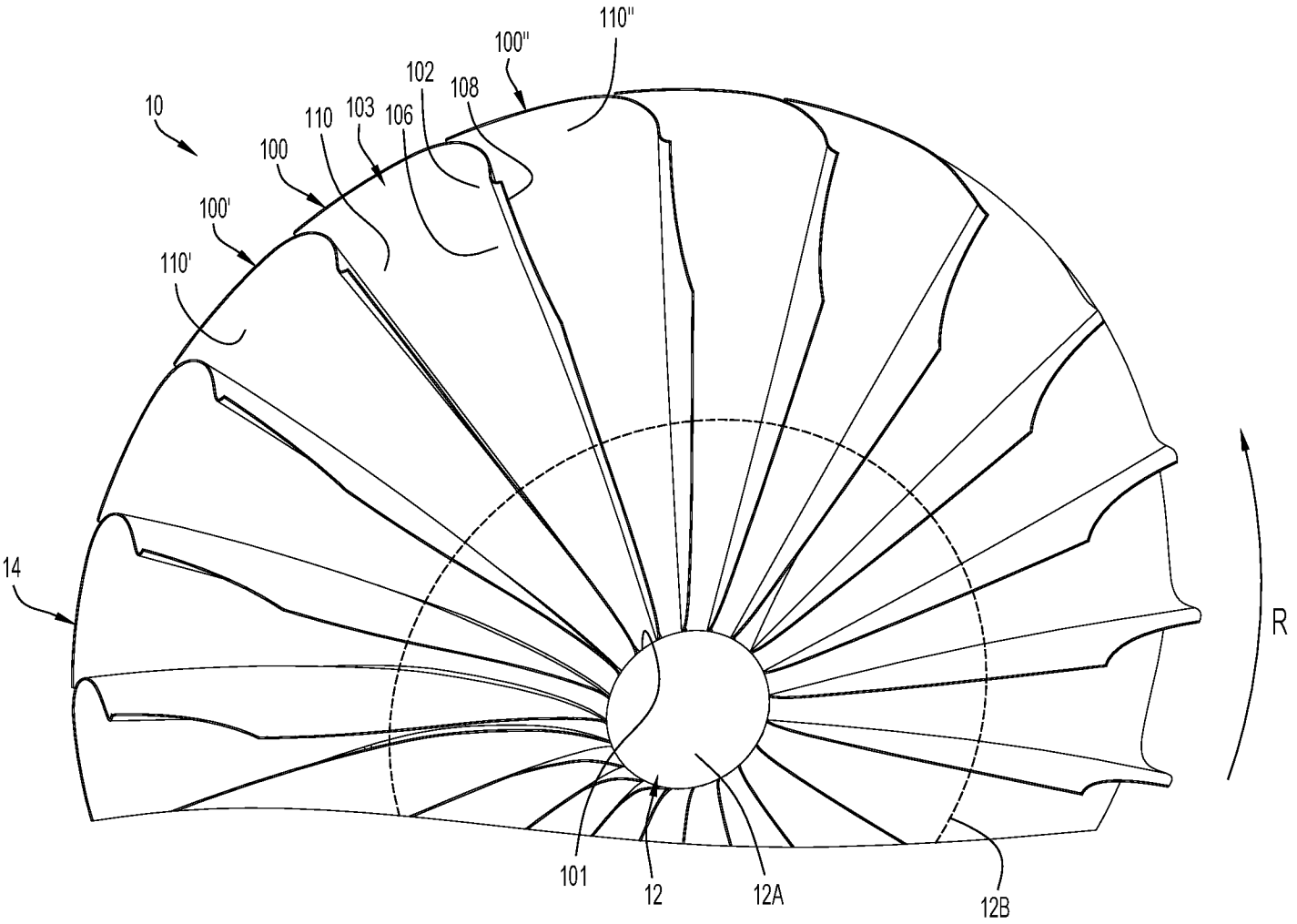
FIG. 3 is a perspective view of a portion of the impeller of FIG. 2 with a cover plate omitted for clarity.

FIG. 3 illustrates the impeller 10 with the cover plate 16 and bladelets 150 omitted to depict the arrangement of blades 100 that form the back plate 14. As mentioned, the blade 100 is disposed circumferentially between a first adjacent blade 100' and a second adjacent blade 100". Additionally, the blades 100 are mechanically coupled or otherwise fastened to the hub 12. The hub 12 includes an upstream end 12A, a downstream end 12B (depicted with a broken line), and an arcuate outer surface 12C (see FIGS. 4A and 4B). In the depicted embodiment, an inner portion of each blade 100 follows the contours of the outer surface 12C of the hub 12 and extends beyond the hub 12. That is, the blades 100 extend from an upstream end 12A of the hub 12, along the outer surface 12C and beyond a downstream end 12B of the hub 12. The blades 100 may extend axially and/or radially beyond the downstream end 12B of the hub 12 to define the back plate 14. However, in other embodiments, an inner portion of each blade may extend along the hub 12 in any desirable manner (and the hub 12 may have any desirable shape or size).

The back plate 14 is defined by platforms 110 extending from blade roots 102 (e.g., bottom or proximal edges) of each blade 100. More specifically, each blade 100 includes a pressure side 106 and a suction side 108, opposite the pressure side 106, and a platform 110 extending along the blade root 102 from the pressure side 106 in a circumferential direction (e.g., rotational direction R). The platform 110 may extend substantially perpendicularly from the blade root 102. That is, a transition between the platform 110 and the blade root 102 may be curved to define a radius.

In the depicted embodiment, the first adjacent blade 100' is disposed on the pressure side 106 of the initial blade 100 (e.g., circumferentially offset in the rotational direction R), and the second adjacent blade 100" is disposed on the suction side 108 of the initial blade 100 (e.g., circumferentially offset in a direction opposite the rotational direction R). Thus, the platform 110 of the initial blade 100, which extends from the pressure side 106, will extend towards and be coupleable to the first adjacent blade 100', Then, eventually, the blades 100 cooperate with adjacent blades 100' to define the back plate 14.

Moreover, in the depicted embodiment, the pressure side 106, the suction side 108, and the platform 110 extend from the upstream end 101 to the downstream end 103. Thus, a platform 110 that extends to the first adjacent blade 100' will close any open space between the pressure side 106 of the blade 100 and the suction side 108 of the first adjacent blade 100'. That is, the platform 110 extends from the pressure side 106 of the blade 100 in the rotational direction R and engages the suction side 108 of the first adjacent blade 100' to create a complete portion of a back plate 14 therebetween. Likewise, the platform 110' of the first adjacent blade 100' engages another blade adjacent to the first adjacent blade 100'. Meanwhile, a platform 110" of a second adjacent blade 100" engages the suction side 108 of the initial blade 100. Thus, each platform 110 of each blade sequentially engages an adjacent blade until the platform 110" of the second adjacent blade 100" engages the initial blade 100, thereby forming the impeller 10 and a complete back plate 14.

In some implementations, the platform 110 may engage the platform 110' of the first adjacent blade 100' or the platform 110" of the second adjacent blade 100". That is, the platform 110 may extend in the direction of rotation R or in a direction opposite the direction of rotation R. Regardless of the direction in which the platforms 110 extend, the platforms 110 cooperate with adjacent blades 100', 100" to define at least a portion of the back plate 14, Moreover, in any case, the platforms of adjacent blades may be engaged in any desirable manner. In the depicted embodiment, the initial blade 100 is fixed to the hub 12 and the platform 110 of the blade 100 engages a first adjacent blade 100', also fixed to the hub 12. In some instances, this may be sufficient to position the blades in positions that creates an engagement between adjacent platforms and/or blades. Additionally or alternatively, platforms might be mechanically connected together. For example, a platform might define a mechanical feature that allows adjacent blades to nest, mate, and/or key with each other. Still further, adjacent blades might be secured together with one or more fasteners, detent structures, biasing structures, or any combination thereof. However, advantageously, when the blades are formed from a composite material (e.g., carbon fiber), fasteners (or any other coupler/coupling technique) may be spaced along the overlapping and/or contacting surfaces (e.g., three fasteners, evenly spaced, connecting a platform to an adjacent blade root).

Figure 4B:
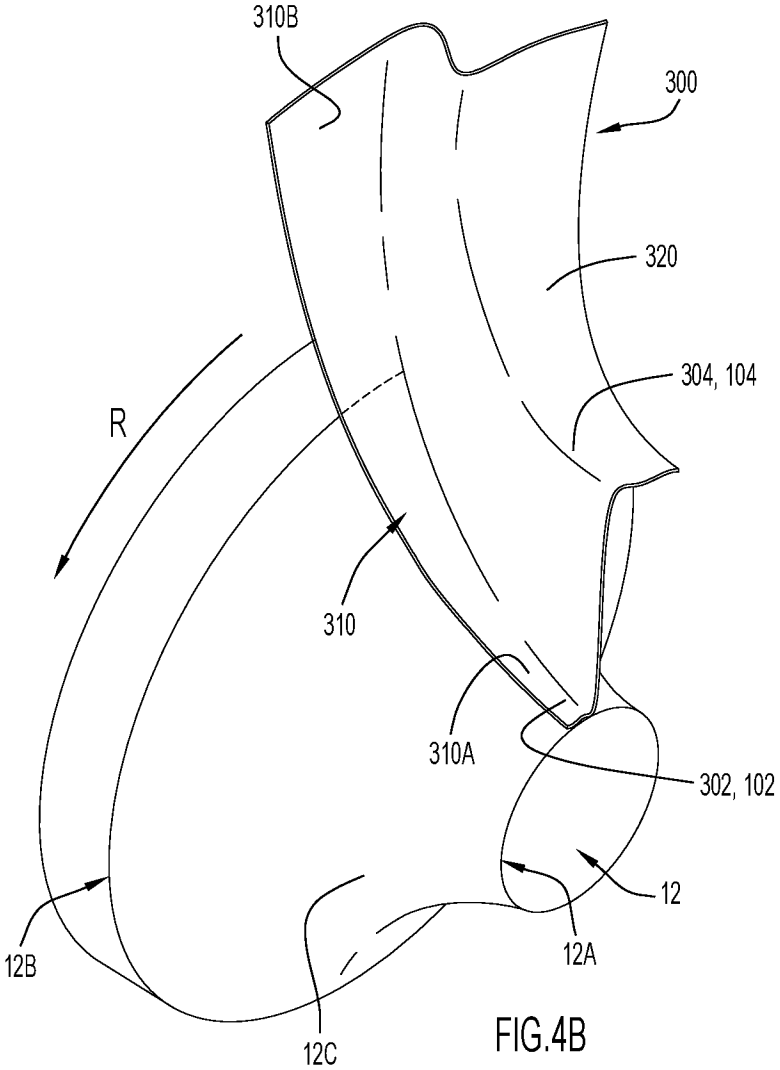
FIG. 4B is a perspective view of an impeller blade of the impeller of FIG. 2 according to a second embodiment.
Figure 4A:
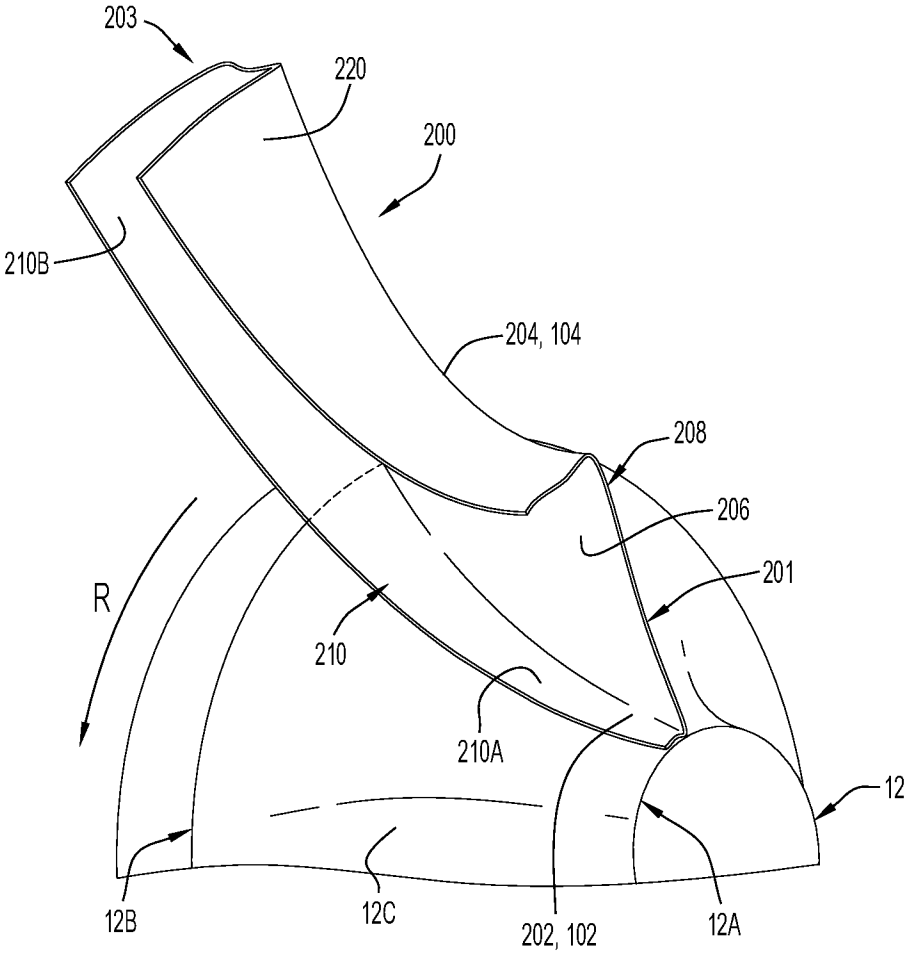
FIG. 4A is a perspective view of an impeller blade of the impeller of FIG. 2, according to a first embodiment.

Now turning to FIGS. 4A and 4B, the blades 100 further define the cover plate 16 in a similar manner to the back plate 14. As examples, FIGS. 4A and 4B depict isolated blades 200, 300 with a shroud or rim portions 220, 320 according to two embodiments, each of which may be representative of the blades 100, 100', and 100" illustrated in FIGS. 2 and 3 (insofar as each may be patterned circumferentially to form a complete impeller). FIG. 4A illustrates an isolated blade 200 having a U-shaped configuration, and FIG. 4B illustrates an isolated blade 300 with a Z-shaped configuration. Despite the different structures, both shroud portions 220, 320 can cooperate with adjacent blades (not shown) to define the cover plate 16 (see FIG. 2).

Each of these blades is described in further detail below. However, before turning to the depicted embodiments, it should be understood that the shroud portions of adjacent blades (e.g., shroud portions 220, 320) can engage with each other in any desirable manner, similar to the platforms (although, to be clear, platforms and shroud portions need not engage in the same manner). For example, in the depicted embodiments, a plurality of blades 200, 300 may be coupled to the hub 12 and this may be sufficient to position the blades in positions that creates an engagement between adjacent shroud portions and/or blades. Additionally or alternatively, shroud portions might be mechanically connected together. For example, a shroud portion might define a mechanical feature that allows adjacent blades to nest, mate, and/or key with each other. Still further, adjacent blades might be secured together with one or more fasteners, detent structures, biasing structures, or any combination thereof. However, to reiterate, when the blades are formed from a composite material (e.g., carbon fiber), fasteners (or any other coupler/coupling technique) may be spaced along the overlapping and/or contacting surfaces (e.g., three fasteners, evenly spaced, connecting a shroud to an adjacent blade tip).

Now turning to FIG. 4A, in this embodiment, the blade 200 includes a blade root 202 (e.g., bottom edge) and a blade tip 204 (e.g., top edge). The blade root 202 is a portion of the blade 200 that is adjacent to and engages the hub 12. The blade tip 204 is a portion of the blade 200 opposite the blade root 202. More specifically, the blade root 202 is a radially inner portion of the blade 200 at an upstream end 201 and transitions to an axially rear portion of the blade 200 at a downstream end 203. Thus, the blade root 202 follows the arcuate surface 12C of the hub 12 and extends beyond the downstream end 12B of the hub 12. Meanwhile, the blade tip 204 is a radially outer portion of the blade 200 at the upstream end 201 and transitions to an axially forward portion of the blade 200 at the downstream end 203 (with respect to the blade root 202).

A platform 210 extends laterally/circumferentially from a pressure side 206 of the blade root 202 and a shroud portion 220 extends latterly/circumferentially from the pressure side 206 of the blade tip 204. The shroud portion 220 may extend substantially perpendicularly from the blade tip 204. That is, a transition between the blade tip 204 and the shroud portion 220 may be curved to define a radius.

In the embodiment depicted in FIG. 4A, the platform 210 and the shroud portion 220 extend parallelly in the same, circumferential direction (e.g., a counterclockwise direction or the direction of rotation R about the hub 12). The platform 210 includes an upstream portion 210A that extends along the hub 12 and a downstream portion 210B that extend beyond the hub 12. That is, the downstream portion 210B is the portion of the platform 210 extending beyond downstream end 12B of the hub 12. The broken line distinguishes the upstream portion 210A from the downstream portion 210B. The downstream portion 210B forms a portion of the back plate 14. Accordingly, each downstream portion 210B of each platform 210 of each blade 200 engages a downstream portion of a platform of an adjacent blade to define the back plate 14 (see FIG. 3). In some implementations, the downstream portions 210B of each platform 210 engages a suction side 208 of blade root 202 of an adjacent blade (e.g., blade 100' of FIGS. 2 and 3). In yet another implementation, an entirety of the platform 210 engages a platform and/or blade root 202 of an adjacent blade (e.g., adjacent blade 100' of FIGS. 2 and 3).

Meanwhile, the shroud portion 220 extends along the blade tip 204 from the upstream end 201 to the downstream end 203. The shroud portion 220 further extends in the direction of rotation R (e.g., the counterclockwise direction) to engage a blade tip and/or shroud portion of an adjacent blade (e.g., adjacent blade 100' of FIG. 2). When a plurality of blades 200 are arranged around the hub 12, each shroud portion 220 of each blade 200 engages a blade tip and/or shroud portion of an adjacent blade (e.g., first adjacent blade 100') to define at least a portion of the cover plate 16 in a similar manner as the platforms 110 defining the back plate 14 in FIG. 3, Accordingly, each shroud portion 220 of each blade 200 engages an adjacent tip and/or shroud portion of an adjacent blade (e.g., adjacent blade 100' of FIG. 2) to define the cover plate 16.

Now referring to FIG. 4B, a blade 300 according to the second embodiment is illustrated. The blade 300 is substantially similar to the U-shaped blade 200 and like reference numbers identify like elements; however, blade 300 has a Z-shape configuration. For example, the blade 300 includes a platform 310 extending from a blade root 302 in the direction of rotation R (e.g., counterclockwise direction) about the hub 12. The broken line distinguishes an upstream portion 310A of the platform 310 from the downstream portion 310B of the platform 310.

The blade 300 further includes a shroud portion 320 circumferentially extending from a blade tip 304 in a clockwise direction about the hub 12. A transition between the blade tip 304 and the shroud portion 320 may be curved to define a radius. Ultimately, the shroud portion 320 extends from the blade tip 304 parallel and opposite to the platform 310. Thus, when a plurality of blades 300 are fixed to the hub 12, each blade 300 engages both a first adjacent blade (e.g., adjacent blade 100' of FIG. 2) and a second adjacent blade (e.g., blade 100" of FIG. 2). That is, each platform 310 engages the first adjacent blade (e.g., adjacent blade 100' of FIG. 2) to define the back plate 14, and each shroud portion 320 of each blade 300 engages a tip 304 and/or shroud portion 320 of a second adjacent blade (e.g., adjacent blade 100" of FIG. 2) to define the cover plate 16.

Figure 5:
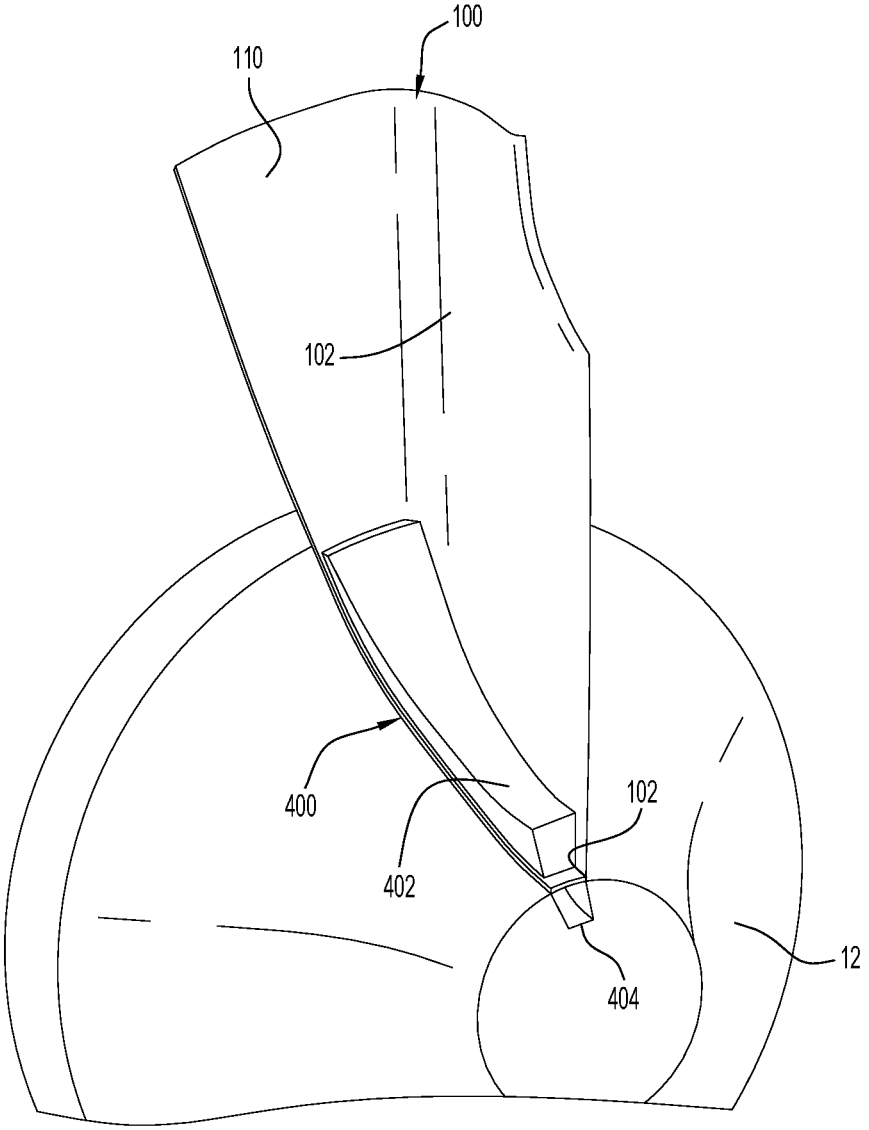
FIG. 5 is a perspective view of a fixing mechanism for attaching an impeller blade to a hub, according to one or more embodiments.

Now referring to FIG. 5, with continued reference to FIGS. 2 and 3, a coupling or fixing mechanism 400 to mechanically fix each blade 100 to the hub 12 is illustrated, in the depicted embodiment, an isolated blade 100 may be representative of blades 200 and 300 of FIGS. 4A and 4B with the shroud portion 220, 320 omitted. The fixing mechanism 400 may include a tang 402 and groove 404. In the depicted embodiment, the groove 404 is disposed in the hub 12 and substantially follows a contour of the platform 110 of the blade 100. Additionally, the tang 402 substantially follows the groove 404 and is configured to couple the platform 110 and/or blade root 102 to the hub 12 via, an interference fit between the tang 402, blade 100 and groove 404. That is, when the tang 402 and blade root 102 and/or platform 110 are disposed in the groove 404, the tang 402 presses the blade root 102 and/or platform 110 into dose contact with the groove 404 and frictional forces prevent movement of the blade 100. Thus, the blade 100 is mechanically secured to the hub 12. Moreover, each blade 100 may be secured to the hub with a corresponding a fixing mechanism 400. That is, a plurality of tangs 402 and grooves 404 may be disposed about the hub 12 to receive the plurality of blades 100. Additionally, or alternatively, a single tang may couple a plurality of blades 100 in a plurality of grooves 404. Further, multiple tangs 402 may be used to couple a single blade 100 to the hub 12.

Alternatively, the groove 404 may be omitted from fixing mechanism 400, and a plurality of tangs 402 may couple a plurality of blades 100 to the hub 12. For example, a plurality of blades 100 may be arranged about the hub 12 with a plurality of tangs 402. Each tang 402 may sequentially apply a fixing pressure to each an adjacent blade until a tang 402 corresponding to another blade applies a fixing pressure to the initial blade 100 and tang 402. With the blades 100 fixed to the hub 12, the shroud portions of the blades 100 (not shown) may engage blade tips and/or shroud portions of adjacent blades (see FIG. 2) and the platforms of the blades may engage blade roots and/or platforms of adjacent blades (see FIG. 3). Consequently, the tangs 402 couple the blades 100 together along the hub 12 via an interference fit, and the assembled blades 100 firm the back plate 14 and the cover plate 16. Additionally, removal of a tang 402 may disengage the blades 100 from the hub 12 allowing for replacement of one or more blades 100, In some implementations, a single fixing mechanism may couple two or more blades 100 together. For example, the fixing mechanism may have a comb-like shape and have multiple tangs extending from a base that engage roots of multiple blades.

In some implementations, the fixing mechanism 400 may adjust the flow volume or flow rate of the impeller 10 (see FIG. 2). For example, the fixing mechanism 400 may attach to the hub 12, blade root, and/or platform, and have a radial thickness that determines an area. of the impeller inlet 10A (see FIG. 2). The flow volume of the impeller may be, at least partially, based on the area of the impeller inlet 10A. Consequently, selecting a radial thickness of the fixing mechanism 400 may set a flow volume of the impeller 10.

Additionally, or alternatively, the blades 100 may be replaced with blades having a platform with a different radial thickness than the original blade platforms to thereby increase or decrease the area of the impeller inlet 10A, and thus, change the flow volume or flow rate of the impeller. Additionally, or alternatively, the new blades may have a longer or shorter downstream portion 210B, 310B (see FIGS. 4A and 4B) to increase or decrease an overall radius of the impeller 10. Consequently, an outlet area defined by the impeller outlet 10B (see FIG. 2) may be increased or decreased, thereby increasing or decreasing the flow rate of the impeller. Accordingly, the impeller 10 may be easily retrofitted to adjust the flow volume and/or flow rate.

However, in some implementations, the blades need not be coupled to the hub 12 with a fixing mechanism, and the blade shroud portions 220, 320 and/or blade platforms 110 may cooperate to couple the blades 100 directly to each other and/or the hub 12. For example, as mentioned, the platforms 110 and/or shroud portions 220, 320 may each include an engagement mechanism configured to couple to another blade root 102/platform 110 and blade tip 104/shroud portion 220, 320, respectively. For example, the platform 110 may include a first protrusion configured to engage a first receiving member (e.g., a slot) disposed in a blade root 102 and/or platform 110 of an adjacent blade 100'. Similarly, the shroud portion 220, 320 may include a second protrusion configured to engage a second receiving member disposed in a blade tip 104 and/or shroud portion 220, 320 of an adjacent blade (e.g., first adjacent blade 100' and/or second adjacent blade 100" of FIG. 2). Thus, the engagement mechanisms of the platforms 110 and shroud portions 220, 320 may couple the blades 100 together about the hub 12. The coupling of the plurality of blades 100 about the hub 12 may cause the blades roots 102 and/or platforms 110 to apply a pressure to the hub 12 to create an interference fit therebetween. Thus, the blades 100 and hub 12 couple together to define an enclosed impeller 10.

In some implementations, the arcuate surface 12C of the hub 12 may include an anti-slip feature to prevent the hub 12 from rotating independently from the plurality of blades 100. For example, the arcuate surface 12C may be a rough surface to increase the friction between the coupled blades 100 and the hub 12. Additionally, or alternatively, the anti-slip feature may include one or more protrusions (i.e., keying features) extending perpendicularly from the arcuate surface 12C. The one or more protrusions may engage a receiving element (e.g., slot) in one or more of the blades 100 to prevent rotation between the hub 12 and the blades 100. Alternatively, the anti-slip feature may include at least one protrusion extending from at least one blade 100 and configured to engage at least one receiving element in the hub 12 to thereby prevent movement between the hub 12 and blades 100. In some implementations, the anti-slip feature may include protrusions extending from each of the hub 12 and the assembly of blades 100 and configured to engage corresponding receiving elements (e.g., slots) in each of the assembly of blades 100 and the hub 12 to thereby prevent movement between the hub 12 and assembly of blades 100. In some instances, one or more of the blades 100 may be coupled to the hub via a screw or bolt.

Embodiments are not limited to any specific means for removably fixing the blades 100 together with the hub 12. Regardless of the specific fixing means, the blades 100 removably couple to each other and the hub 12 to define the impeller 10 with a back plate 14 and cover plate 16. Accordingly, if a portion of the impeller 10 is damaged, one or more damaged blades 100 may be mechanically uncoupled or removed from the assembly of blades and replaced with new one or more new blades to repair the impeller 10.

Figure 6:
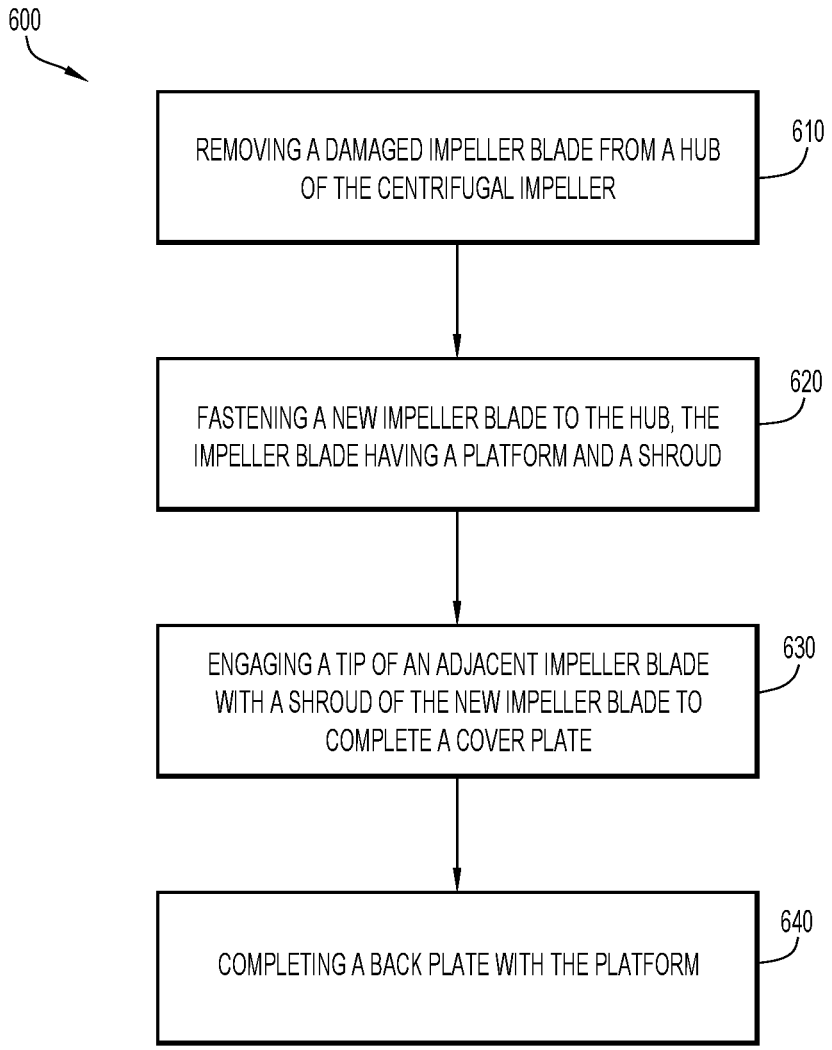
FIG. 6 is a flow diagram of a method for repairing a centrifugal impeller, according to an embodiment.

Referring to FIG. 6, a method 600 for repairing a centrifugal impeller (e.g., impeller 10) is depicted. The method includes removing a damaged impeller blade from a hub of the centrifugal impeller in operation 610, and fastening a new impeller blade to the hub in operation 620, the impeller blade having a platform and a shroud. The method further includes engaging a tip of an adjacent impeller blade with a shroud of the new impeller blade to complete a cover plate in operation 630; and completing a back plate with the platform in operation 640. In some implementations, the method may further include engaging a blade root of the adjacent impeller blade with the platform. Alternatively, in some implementations, the method may further include engaging a blade root of a second adjacent impeller blade with the platform.

In some implementations, removing the damaged impeller blade from the hub may include disengaging the platform of the damaged impeller blade from one of the adjacent impeller blade or a second adjacent impeller blade. Additionally, or alternatively, removing the damaged impeller blade from the hub may include disengaging the shroud of the damaged impeller blade from the adjacent impeller blade.

Each example embodiment disclosed herein has been included to present one or more different features. However, all disclosed example embodiments are designed to work together as part of a single larger system or method. This disclosure explicitly envisions compound embodiments that combine multiple previously-discussed features in different example embodiments into a single system or method.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Reference may be made to the spatial relationships between various components and to the spatial orientation of various aspects of components as depicted in the attached drawings. However, as will be recognized by those skilled in the art after a complete reading of the present disclosure, the devices, components, members, apparatuses, etc. described herein may be positioned in any desired orientation. Thus, the use of terms such as "above," "below," "upper," "lower," "top," "bottom," or other similar terms to describe a spatial relationship between various components or to describe the spatial orientation of aspects of such components, should be understood to describe a relative relationship between the components or a spatial orientation of aspects of such components, respectively, as the components described herein may be oriented in any desired direction. When used to describe a range of dimensions and/or other characteristics (e.g., time, pressure, temperature, distance, etc.) of an element, operations, conditions, etc., the phrase "between X and Y" represents a range that includes X and Y.

For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment.

Further, the present disclosure may repeat reference numerals and/or letters in the various examples. This repetition is for the purpose of simplicity and clarity and does not in itself dictate a relationship between the various embodiments and/or configurations discussed.

Similarly, when used herein, the term "comprises" and its derivations (such as "comprising," etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

As used herein, unless expressly stated to the contrary, use of the phrase "at least one of," "one or more of," "and/or," variations thereof, or the like are open-ended expressions that are both conjunctive and disjunctive in operation for any and all possible combination of the associated listed items. For example, each of the expressions "at least one of X, Y and Z," "at least one of X, Y or Z," "one or more of X, Y and Z," "one or more of X, Y or Z" and "X, Y and/or Z" can mean any of the following: 1) X, but not Y and not Z; 2) Y, but not X and not Z; 3) Z, but not X and not Y; 4) X and Y, but not Z; 5) X and Z, but not Y; 6) Y and Z, but not X; or 7) X, Y, and Z.

Additionally, unless expressly stated to the contrary, the terms "first," "second," "third," etc., are intended to distinguish the particular nouns they modify (e.g., element, condition, node, outlet, inlet, valve, module, activity, operation, etc.). Unless expressly stated to the contrary, the use of these terms is not intended to indicate any type of order, rank, importance, temporal sequence, or hierarchy of the modified noun. For example, "first X" and "second X" are intended to designate two "X" elements that are not necessarily limited by any order, rank, importance, temporal sequence, or hierarchy of the two elements. Further as referred to herein, "at least one" or and "one or more of" can be represented using the "(s)" nomenclature (e.g., one or more element(s)).

The invention claimed is:

1. An enclosed centrifugal impeller comprising:
- a hub; and
- a plurality of replaceable impeller blades coupled to the hub, each replaceable impeller blade comprising:
  - a root;
  - a tip;
  - a platform extending laterally from the root; and
  - a shroud extending laterally from the tip to engage another tip of an adjacent impeller blade,
- wherein the plurality of replaceable impeller blades and the hub define the enclosed centrifugal impeller.

2. The enclosed centrifugal impeller of claim 1, wherein the shrouds of the plurality of replaceable impeller blades cooperate to define a cover plate.

3. The enclosed centrifugal impeller of claim 1, wherein at least one of the platform and the shroud includes an engagement mechanism for coupling the plurality of replaceable impeller blades.

4. The enclosed centrifugal impeller of claim 1, wherein each platform of each replaceable impeller blade is configured to engage another root of the adjacent impeller blade to define a back plate.

5. The enclosed centrifugal impeller of claim 1, wherein each platform of each replaceable impeller blade is configured to engage another root of another impeller blade to define a back plate.

6. The enclosed centrifugal impeller of claim 1, wherein each replaceable impeller blade is removably coupled to the hub.

* * * * *